United States Patent [19]

Kozel

[11] Patent Number: 4,986,767

[45] Date of Patent: Jan. 22, 1991

[54] BLADE FUSE POWER TAP

[76] Inventor: Emmett L. Kozel, Rte. 1 Box 206, Rockingham, N.C. 28379

[21] Appl. No.: 512,441

[22] Filed: Apr. 23, 1990

[51] Int. Cl.[5] ..... H01R 4/36; H01R 13/68

[52] U.S. Cl. ..... 439/621; 439/801; 337/255

[58] Field of Search ..... 337/187, 188, 255, 260–264, 337/198; 439/621, 622, 810, 814, 801, 803, 346, 359, 362, 625

[56] References Cited

U.S. PATENT DOCUMENTS

| | | | |
|---|---|---|---|
| 3,909,767 | 9/1975 | Williamson et al. | 337/264 |
| 4,221,455 | 9/1980 | Cairns et al. | 439/621 |
| 4,327,638 | 5/1982 | Wassermann | 335/230 |
| 4,344,060 | 8/1982 | Ciesemier et al. | 337/260 |
| 4,372,638 | 2/1983 | Sohler | 439/621 |
| 4,427,258 | 1/1984 | Mueller | 439/814 |
| 4,499,447 | 2/1985 | Greenberg | 337/241 |
| 4,555,638 | 11/1985 | Lobe | 439/622 |
| 4,884,050 | 11/1989 | Kozel | 439/830 |

FOREIGN PATENT DOCUMENTS 2940607 4/1981 Fed. Rep. of Germany .

*Primary Examiner*—Gary F. Paumen

*Attorney, Agent, or Firm*—Dowell & Dowell

[57] ABSTRACT

A connector for tapping power from a flat blade miniature plug-in fuse which includes a clamp which is of a size to engage the top portion of the fuse and an electrical terminal element which is carried by the clamp so as to be selectively urged into electrical contact with a portion of a fuse blade oriented within the body of the fuse.

16 Claims, 1 Drawing Sheet

BLADE FUSE POWER TAP

BACKGROUND OF THE INVENTION

1. Field of the Invention

This invention is generally directed to electrical fuse elements of the flat blade miniature plug-in type which are commonly used in the automotive and electronics industries and more specifically to electrical connectors which may be mounted to such conventional blade fuses for purposes of tapping power from the electrical conductors associated with such fuses. The power taps or tap adaptors of the present invention include a clamp member having spaced leg portions which may be engaged with the top portion of the conventional blade fuse. The clamp member includes a threaded bore which is aligned with a test probe opening in the upper surface of the blade fuse. One of a number of varying configurations of terminal elements may be selectively threaded through the bore in the clamp and brought into electrical contact with a current carrying test tab or portion of the conductor disposed within the fuse. Each terminal element will be provided with a suitable male or female contact so that power, through the fuse, can be selectively supplied to electrical components, instruments or devices for which dedicated or specific fuses have not been provided.

2. History of the Related Art

The use of flat blade miniature plug-in type fuses continues to grow in popularity thereby replacing the more conventional glass cylinder type fuses which have been associated with the automotive and electrical industries. Flat terminal blade miniature plug-in fuses generally include an electrically insulated housing having a pair of conductor blades extending therefrom. The blades are connected within the housing by a thin strip of electrical conducting material which is designed to fail at a given amperage so as to prevent an overload through the fuse when the fuse is placed in an electrical circuit. Such fuses are commonly utilized in the automotive industry to protect circuits including headlight, taillight and courtesy light circuits as well as heater circuits, windshield wiper motor circuits, radio circuits and other related electronic circuits wherein the fuses prevent overloads through such circuits. The housings are generally formed of a translucent or transparent plastic material so that a quick visual indication of a fuse failure may be readily observed through the housing In addition, such conventional fuses normally include one or more openings adjacent the upper portion of the fuse through which a test probe may be inserted so as to contact an electrical tab associated with one of the conducting blades to thereby readily indicate whether or not there is power flowing through the fuse.

A further characteristic of many conventional flat blade terminal fuses is that the upper end of the fuse housing normally incorporates a flanged portion which facilitates the manual handling of the fuse. Some examples of conventional flat terminal blade miniature plug-in fuses are disclosed in Williamson, et al. U.S. Pat. No. 3,909,767, Ciesemier, et al. No. 4,344,060, Greenberg No. 4,499,447, and West German Pat. No. DE 2940607 dated Apr. 16, 1981.

Although the introduction of flat blade miniature plug-in fuses has resulted in a significant improvement in the economy and the handling of fuse elements, especially of the type which are utilized in automotive vehicles and other electrical systems, there remain problems associated with the installation of new electrical equipment for which dedicated fuses have not been provided. In many instances, it may be desired to install auxiliary electrical equipment such as radios, cassette players, televisions, modems and telephones into vehicles such as cars, trucks and vans. When such equipment is installed in a vehicle it must be connected to an electrical circuit of the vehicle's electrical system. Further, to ensure safety of the electrical circuit, such circuits must be connected through fuses so that the circuits are protected from overloads. In the automotive industry, such fuses are normally set at an amperage rating which may vary between five and thirty amps.

Previously, in order to connect auxiliary electrical equipment to an existing electrical circuit, it was necessary to tap one of the electrical wires leading to or from the fuse box or panel associated with the electrical system. Such connections are not only unsafe but require a great deal of experience and knowledge in identifying which electrical lines may be appropriately spliced to provide power to the auxiliary equipment. In addition to being unsafe, such a process is very time consuming and therefore costly. Also, in many instances, the complexity of the electrical wiring or electrical harnesses associated with the circuitry of given equipment and especially automotive equipment is such that an installer must have access to the electrical plans or diagrams associated with the electrical system in order to identify which electrical lines may be utilized for purposes of providing power to auxiliary equipment.

In order to forego many of the difficulties associated with tapping into an electrical line, many installers of auxiliary electrical equipment simply tap into a fuse within the fuse box of an electrical circuit. Generally, an electrical wire from the auxiliary equipment is wrapped around, and in electrical contact with, one of the blade elements associated with a fuse, such as a miniature plug-in fuse, and thereafter the fuse inserted into the appropriate socket. Such a loose connection is not only unsafe but is easily disrupted by vibration or accidental contact. Due to the small dimensions between the terminals of conventional blade fuses, attempts to wrap or otherwise attach supplemental electrical wires to one of the terminals can result in an arcing between the terminals creating a safety problem if the load of the fuse selected becomes excessive or shorted causing the fuse to blow. In instances where the auxiliary electrical line includes a larger gauge of electrical wire, it is difficult to wrap or solder such an auxiliary line to the blades or terminals associated with conventional fuses.

To overcome the obvious unsafe and impractical conventional tapping of electrical fuse elements, in applicants prior U.S. Pat. No. 4,884,050 a blade terminal tap fuse is disclosed which allows for a flat terminal blade miniature type plug-in fuse to be modified to provide an easily accessible source of electrical current. In applicant's patent, one or both of the terminals associated with conventional flat blade fuses are modified so that the electrical contact elements are in spaced relationship with respect to the upper surface of the fuse housing. Therefore, when one of the blades extends above the fuse housing, a simple female connector may be quickly engaged therewith in order to obtain a source of current supply through the fuse. In those instances where the blade element is recessed within the housing, an opening is provided of a size to permit the female connector to be inserted into the upper portion of the housing in order to engage the terminal member and thereby establish a source of electrical power to auxiliary electrical equipment. Unfortunately, such a fuse requires a modification to existing conventional plug-in type fuses of the flat blade type.

There have been other efforts directed to creating electrical taps for use with various types of fuse blocks or fuse boxes and some examples of such prior art tapping devices are disclosed in Cairns et al. U.S. Pat. No. 4,221,455, Sohler No. 4,327,638 and Lobe No. 4,555,638.

SUMMARY OF THE INVENTION

This invention is directed to power taps or tap adaptors for use with conventional flat terminal blade miniature plug-in fuses wherein the power taps include a clamp member having spaced leg portions which may be engaged with either side and adjacent the top portion of the conventional blade fuse. In the preferred embodiment, a pair of inwardly extending and opposing flanges are associated with each leg portion and are selectively engaged underneath a flange which extends along the top portion of such fuses The clamp member is formed of an electrically insulated material and the leg portions may be slightly yieldable with respect to one another so as to apply a force against the fuse housing when the clamp is mounted thereto. A threaded bore is provided through the upper portion of the clamp intermediate the two leg portions through which one of a number of varying configurations of terminal elements are threadedly received.

When the clamp member of the present invention is mounted to the upper portion of a fuse the threaded bore therethrough will be in alignment with one of the openings in the fuse housing which permits access to the test tab or conducting blades associated with the fuse. In this manner, the terminal elements may be manipulated with respect to the clamp and brought into electrical contact with the test tab to thereby create an electrical circuit through the terminal elements which are formed of electrical conductive material.

The uppermost end of the terminal elements are provided with either conventional male or female electrical connectors to thereby permit an auxiliary electrical wire to be easily connected thereto so that power through the fuse may be provided to an auxiliary electrical circuit.

It is the primary object of the present invention to provide a connector for tapping power from a conventional flat terminal blade miniature plug-in type fuse wherein the tap is accomplished without modification to the fuse and wherein the tap is created within the fuse housing.

It is another object of the present invention to provide a connector for tapping power from a conventional blade type fuse and which include a mounting clamp which is specifically designed to be cooperatively engaged with the conventional fuse so that as the terminal elements associated with the connector are threaded with respect to the clamp, the clamp will be progressively tightened in its seated position with respect to the fuse housing to thereby assure a safe and secure electrical contact between the terminal element and the current conducting blade associated with the fuse.

It is yet a further object of the present invention to provide a connector for tapping power from a conventional blade type fuse wherein the tap may be safely created and is rigidly maintained even under conditions where vibration may otherwise affect the electrical contact between the connector and the fuse.

It is also an object of the present invention to provide a connector for tapping power from a blade type fuse wherein the orientation of the electrical terminal elements associated with the connector may be varied so that the connector may be utilized in various locations.

A BRIEF DESCRIPTION OF THE DRAWINGS

DESCRIPTION OF THE PREFERRED EMBODIMENT

Figure 1:
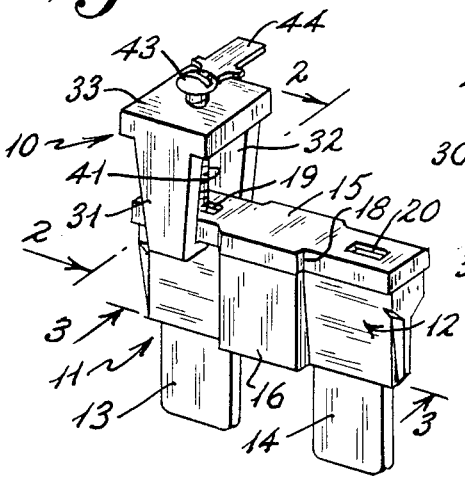
FIG. 1 is a perspective illustrational view of one embodiment of the present invention showing the clamp member mounted to a conventional flat terminal blade miniature plug-in fuse.

With continued reference to the drawings, the electrical connector or tap adaptor 10 of the present invention is shown as being mounted to a conventional flat terminal blade miniature plug-in fuse 11 which includes an insulated housing 12 and flat blade terminal or contact elements 13 and 14. The housing 12 is formed of an electrically insulated material and includes an upper surface 15 and front and rear surfaces 16 and 17, respectively. The upper portion of the housing 12 is provided with an outwardly extending shoulder or flange 18 which extends around the entire periphery of the housing. A pair of openings 19 and 20 are provided through the upper surface 15 and are aligned with the upper tab portions 13, and 14' of the contact elements 13 and 14 of the fuse. The openings 19 and 20 are conventionally provided to allow an electrical probe to be inserted therethrough in order to check circuit continuity through the fuse.

Figure 3:
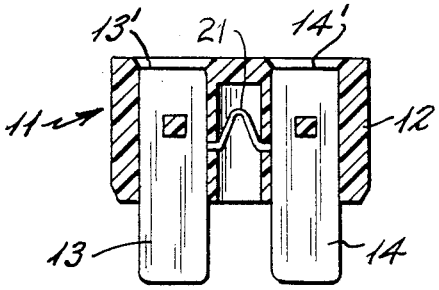
FIG. 3 is a cross-sectional view taken along lines 3—3 of FIG. 1 showing the cross-sectional structure of the conventional fuse element.

With specific reference to FIG. 3 of the drawings, the electrical terminal elements 13 and 14 are shown as being electrically connected by a thin strip of electrically conductive but fusible material 21. The amperage rating of the fuse is determined by the amount of current which can be safely conducted through the element 21. Further it a should be noted that the tab end portions 13' and 14' of the terminal elements 13 and 14 terminate inwardly with respect to the upper surface of the housing.

Figure 2:
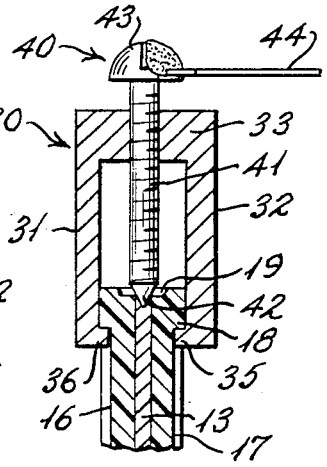
FIG. 2 is a partial cross-sectional view taken along lines 2—2 of FIG. 1.
Figure 4:
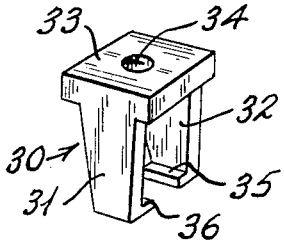
FIG. 4 is a perspective view of the clamp of the power tap or electrical connector of the present invention.

In FIGS. 1, 2, and 4, the electrical connector or power tap 10 is shown as including a mounting clamp 30 having a pair of spaced legs 31 and 32 which extend outwardly from a head 33. A threaded bore 34 is provided through the central portion of the head 33 and intermediate the legs 31 and 32. The lowermost portion of each of the legs are provided with inwardly extending flange elements 35 and 36 which are of a configuration to be cooperatively received in abutting engagement beneath the outwardly extending flange 18 associated with the conventional fuse 11 as is specifically shown in FIGS. 1 and 2.

The clamp 30 is preferably constructed of an electrically insulated or non-conducting plastic material and in some embodiments, the legs 31 and 32 may be integrally formed with respect to the head 33 in such a manner that they may be slightly yieldable with respect to one another with the legs tapering slightly inwardly away from the head 33 toward the flange elements 35 and 36. In this manner, when the clamp is applied to the upper portion of the fuse 11, the legs may be yieldably separated with respect to one another in order to allow the legs to be engaged adjacent the front and rear surfaces 16 and 17, respectively, of the fuse. Thereafter, the legs will tend to be brought into compressive relationship with respect to one another to thereby assure a secure seating of the clamp with respect to the fuse housing as is shown in FIG. 2. The threaded opening 34 should be aligned along a common vertical axis with one of the openings 19 or 20 through the upper surface of the fuse.

In order to establish an electrical contact with either of the tab portions 13' and 14' of the terminal elements 13 and 14 of the fuse, a tap 40 is provided which is threadedly adjustable through the opening 34. The tap is constructed of an electrically conductive material having an elongated threaded shank 41, a pointed tip 42 and an enlarged head 43. Secured to the head 43 are various male or female electrical contacts. The configuration of the contact may vary depending upon the specific environment in which the power tap is to be used. In FIGS. 1 and 2, a blade contact element 44 is shown which extends generally perpendicularly with respect to the axis of the shank 41 of the terminal element.

Figure 5:
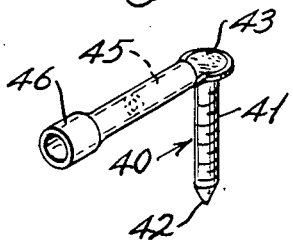
FIGS. 5–7 are three modifications of terminal elements which may be utilized in combination with the clamp shown in FIG. 4.
Figure 6:
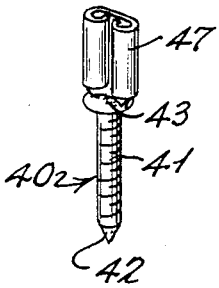
Figure 7:
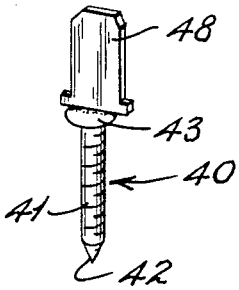

With specific reference to FIGS. 5–7, various alternate configurations for the electrical contacts which extend from the head portion 43 of the terminal elements 40 are disclosed in greater detail In FIG. 5, a tubular socket connector 45 is disclosed as being connected to the head portion 43 of the terminal element and extends transversely and preferably perpendicularly, to the elongated axis of the shank 41. A suitable insulated sleeve 46 is mounted so as to extend over the tubular contact element. In FIG. 6, a female electrical clip member 47 is disclosed being mounted to the head portion 43 of the terminal element. In FIG. 7, the electrical contact element is shown as being a blade element 48 which extends generally parallel or in line with the axis of the shank 41 of the terminal element 40.

In the use of the connector or power tap of the present invention, when it becomes necessary to connect an auxiliary electrical component to an existing fuse within a fuse box, the proper rating of fuse is chosen and the clamp 30 of the power tap is mounted so that the flange elements 35 and 36 of the legs 31 and 32 engage the flange or lip 18 of the upper portion of the fuse. Thereafter a terminal element such as disclosed in either FIGS. 1, 2 , or 5–7 as selected, and the threaded shaft thereof is rotated through the threaded opening 34 in the head 33. The clamp should be mounted so that the opening 34 is aligned with either the opening 19 or 20 in the fuse 11. The terminal element is rotated until the tip portion 42 thereof engages the upper tab portion 13' or 14' associated with either of the blade elements 13 and 14 of the fuse 11. As the tip 42 engages the upper tab portions of either the blades 13 and 14, continued rotation of the terminal element will urge the clamp upwardly relative to the housing 12 of the fuse thereby drawing the flange elements 35 and 36 into very tight and secure engagement with the flange or lip 18 of the housing. With the tap adaptor installed, an appropriate fitting may be secured to the electrical contact elements shown as either 44, 45, 47, and 48 in the drawings. Further modifications can be made to the specific type of electrical contacts which are associated with the head portion 43 of the terminal elements.

I claim:

1. A power tap for use with flat terminal blade miniature plug-in fuses of the type having a housing which includes front and rear surfaces and an upper end and at least one opening in the upper end and which further includes a terminal blade having a portion which is accessible through the opening, the power tap comprising, a clamp means having a head portion and spaced leg portions, an opening through said head portion and intermediate said leg portions, said leg portions being engagable with the front and rear surfaces of the housing of the fuse when said clamp means is mounted thereto, a terminal element mounted within said opening in said head portion and being selectively movable axially with respect thereto, said terminal element having an elongated shank having a lower electrical contact portion and an upper end portion, and an electrical contact member extending from said upper end portion, whereby said terminal element may be selectively adjusted with respect to said opening through said head portion so that said contact portion is movable with respect to said leg portions of said clamp means so as to be selectively urged within the opening in the housing to thereby selectively contact the portion of the terminal blade which is accessible through the opening in the fuse housing.

2. The power tap of claim 1 in which each of said leg portions includes an outer end, and flange elements extending toward one another on each of said outer ends of said leg portions.

3. The power tap of claim 2 in which said clamp means is formed of an electrically non-conductive material.

4. The power tap apparatus of claim 3 in which said leg portions of said clamp means are yieldable with respect to one another.

5. The power tap of claim 3 in which said opening in said head portion of said clamp means is threaded and said shank of said terminal element is cooperatively threaded so as to be adjustable within said opening in said head portion.

6. The power tap of claim 5 in which said electrical contact is a blade element oriented generally in axial alignment with said shank of said terminal element.

7. The power tap of claim 5 in which said electrical contact is a blade element oriented transversely with respect to the axis of said shank of said terminal element.

8. The power tap of claim 5 in which said electrical contact is an electrical socket means which is oriented generally transversely with respect to the axis of said shank of said terminal element

9. The power tap of claim 5 in which said electrical contact is an electrical socket which is oriented generally parallel with respect to the elongated axis of said shank of said terminal element.

10. The power of claim 1 in which said opening in said head portion of said clamp means is threaded and said shank of said terminal element is cooperatively threaded so as to be adjustable within said opening in said head portion.

11. The power tap apparatus of claim 10 in which said leg portions of said clamp means are yieldable with respect to one another.

12. The power tap of claim 1 in which said electrical contact is a blade element oriented generally in axial alignment with said shank of said terminal element.

13. The power tap of claim 1 in which said electrical contact is a blade element oriented transversely with respect to the axis of said shank of said terminal element.

14. The power tap of claim 1 in which said electrical contact is an electrical socket means which is oriented generally transversely with respect to the axis of said shank of said terminal element.

15. The power tap of claim 1 in which said electrical contact is an electrical socket which is oriented generally parallel with respect to the elongated axis of said shank of said terminal element.

16. A power tap for use with flat terminal blade miniature plug-in fuses of the type having a housing which includes front and rear surfaces and an upper end, a flange extending outwardly adjacent the upper end and at least one opening in the upper end and which further includes a terminal blade having a portion which is accessible through the opening, the power tap comprising, a clamp means formed of an electrically insulated material having a head portion and spaced leg portions, a threaded opening through said head portion and intermediate said leg portions, each of said leg portions including an outer end, flange elements extending toward one another on each of said outer ends of said leg portions so as to be engaged with the flange adjacent the upper end of the housing when said clamp means is mounted thereto, a terminal element mounted within said opening in said head portion and being selectively movable axially with respect thereto, said terminal element having an elongated threaded shank having a lower electrical contact portion and an upper end portion, and an electrical contact extending from said upper end portion whereby said terminal element may be selectively adjusted with respect to said opening so that said contact portion is movable with respect to said leg portions of said clamp means so as to be selectively urged within the opening in the housing to thereby selectively contact the portion of the terminal blade which is accessible through the opening in the fuse housing.

* * * * *